United States Patent [19]

Benedetti

[11] 3,970,404

[45] July 20, 1976

[54] METHOD OF RECONSTRUCTING ASPHALT PAVEMENT

[76] Inventor: Angelo W. Benedetti, 94 First St., Bedford, Ohio 44146

[22] Filed: June 28, 1974

[21] Appl. No.: 484,070

[52] U.S. Cl. ..... 404/77

[51] Int. Cl.[2] ..... E01C 7/06

[58] Field of Search ..... 404/72, 77, 79, 95

[56] References Cited

UNITED STATES PATENTS

| | | | |
|---|---|---|---|
| 2,254,463 | 1/1941 | Wells et al. | 404/95 |
| 3,055,280 | 9/1962 | Neville | 404/95 |
| 3,066,582 | 12/1962 | Cutler | 404/95 |
| 3,801,212 | 4/1974 | Cutler | 404/77 |

*Primary Examiner*—Nile C. Byers

[57] ABSTRACT

The invention concerns heating an asphalt pavement in successive stages during time-spaced intervals. This permits the asphalt to be heated to its softening temperature without being overheated, and also permits the heat to penetrate deeply into the asphalt by conduction to soften the asphalt to a substantial depth (e.g. 1 inch or more). The asphalt is then scarified to a depth not greater than the depth to which it has been softened, and the scarified asphalt is then worked into a trafficable surface.

14 Claims, 1 Drawing Figure

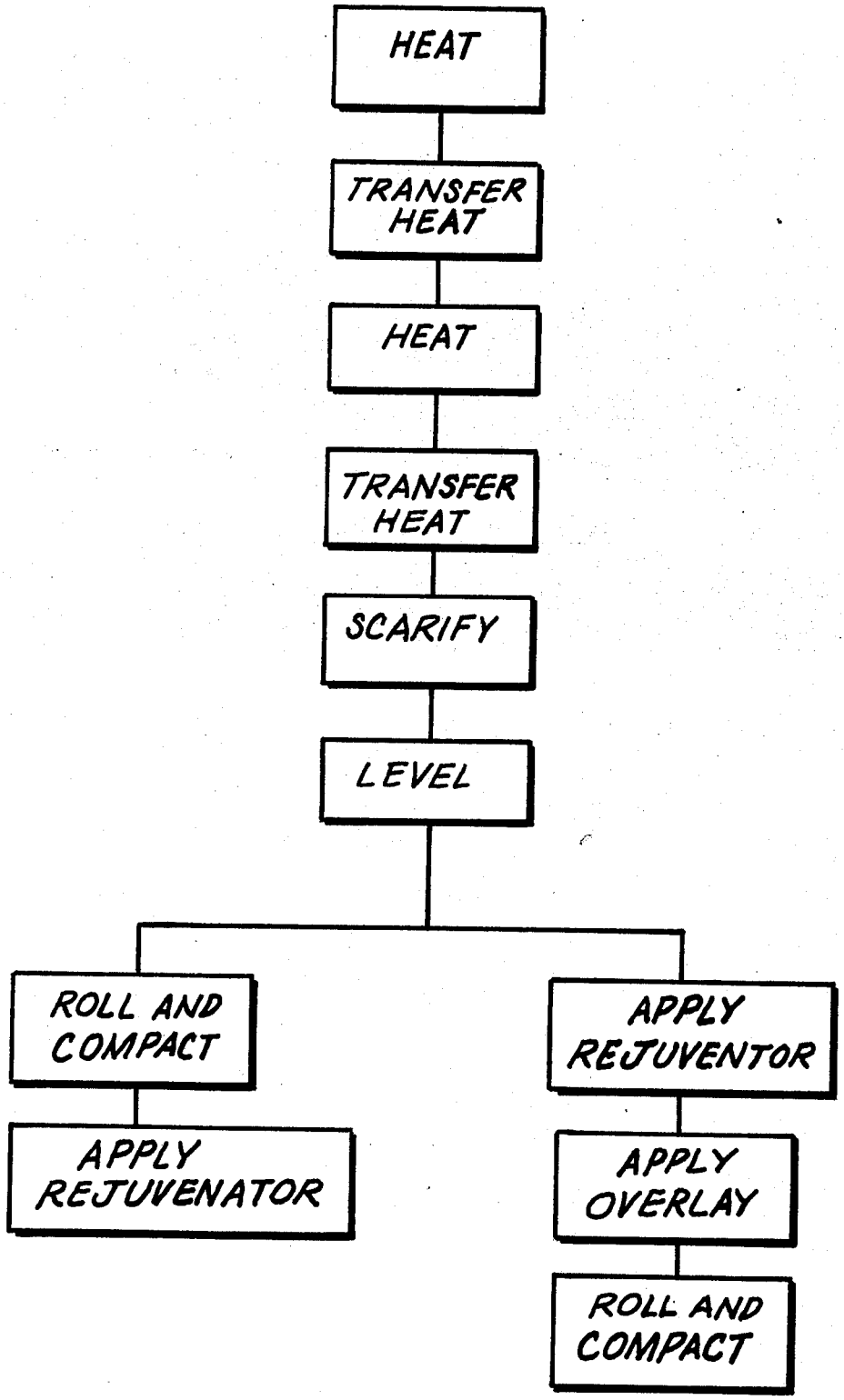
HEAT
TRANSFER HEAT
HEAT
TRANSFER HEAT
SCARIFY
LEVEL
ROLL AND COMPACT
APPLY REJUVENATOR
APPLY REJUVENTOR
APPLY OVERLAY
ROLL AND COMPACT

METHOD OF RECONSTRUCTING ASPHALT PAVEMENT

The present invention relates to the art of asphalt paving, and more particularly, to a method of reconstructing asphalt pavement.

BACKGROUND OF THE INVENTION

With the passage of time, asphalt pavement deteriorates in response to the influence exerted by a variety of factors. These include weather, reaction to traffic load on the pavement surface, change in the composition and physical properties of the asphaltic component of the pavement, faulty base courses and improper drainage.

The impact of these various factors on the asphalt pavement manifests itself variously in cracks, pot holes, dips, bumps, ruts and other irregularities and discontinuities. Ultimately, economic considerations and safety factors dictate that some form of maintenance be performed on the degraded road.

In the past, before the advent of energy shortages and before the spiralling costs of materials and labor became controlling factors in maintenance decisions, a wide variety of repair and reconstruction procedures were available to the authority responsible for road maintenance. These procedures ran the gamut from radical road rebuilding to moderately expensive resurfacing with a 1½ to 2 inch overlay of asphaltic concrete, to minimal maintenance involving patching and/or applying a seal coat.

Many of the options previously open to highway engineers are now closed due to prohibitive costs and/or lack of necessary materials.

In recognition of these problems, attempts have been made to develop asphalt pavement reconstruction methods which maximize the reprocessing and reworking of aged, weathered asphalt pavement, and in this manner, minimize labor, transportation and new material requirements. Exemplary of these procedures are the teachings of U.S. Pat. No. 3,361,042 issued Jan. 2, 1968, which describes a method of reconditioning a highway of asphalt concrete by heating the concrete, scarifying it, mixing the materials, planing, leveling, and kneading it, and finally, rolling and compacting it into a reconditioned surface. According to the patent, the steps can be accomplished with or without the addition of new asphaltic paving materials.

Procedures of the type described in U.S. Pat. No. 3,361,042, although of substantial interest because of economic considerations, have met with only limited commercial success. One of the major problems appears to be the inability of such prior art techniques to effect a deep enough scarification to get below cracks, ruts and pot holes, without unduly disturbing the asphalt concrete matrix.

For example, according to the teachings of U.S. Pat. No. 3,361,042, scarification is effected to a depth below which the applied heat softens the asphalt pavement. The unheated material is physically brought to the surface where it is broken up into random rubble and then heated to soften it. This process not only requires the expenditure of substantial mechanical energy to scarify but tends to promote both comminution and segregation of aggregate. Both of these phenomena have the adverse effect of decreasing the strength, stability and load bearing capacity of the asphalt pavement.

Thus, the *Asphalt Plant Manual*, 3rd Edition, published by The Asphalt Institute, states at p. 54 that undue segregation of an asphalt mix results in nonuniform distribution of the material in the pavement, and this can lead to a patchy appearance as well as early structural distress. Similarly, *Highway Engineering*, 3rd Edition, by Ritter and Poquette, published by The Roland Press Company, 1967, points out at p. 561 that even excessive rolling can result in the crushing of aggregate particles or the breaking of the asphalt bond, which is, of course, undesirable.

SUMMARY OF THE INVENTION

The present invention overcomes the deficiencies of the prior art methods by providing a method in which deep scarification is effected, of 1 inch or more, after the asphalt pavement has been softened to the full depth to which it is scarified, by a novel heating method described more fully hereinafter. The heating is accomplished in such a rapid and efficient manner that such deep scarification of pre-softened asphalt pavement can be accomplished on a continuous basis in a single pass, at a rate within the range of about 12 to about 36 ft./min.

The advantage of scarifying softened asphalt pavement to a depth of 1 inch or better is that disturbance to the asphalt pavement matrix is minimal and segregation and comminution of aggregate is virtually eliminated. Moreover, the need for the application of an overlay of fresh asphaltic paving material is not required because the reconditioning of the existing pavement is so complete. Merely leveling, rolling, and compacting, and treating the scarified material with a penetration increasing agent, provides a trafficable surface which will provide equivalent service to a pavement reconditioned in accordance with conventional techniques and provided with a standard thickness overlay. Where desired, however, for purposes of aesthetics or to comply with Federal, State or local specifications for reconditioning procedures, overlays may be provided. Because of the more thorough reconditioning of the underlying asphalt pavement provided by the present invention, overlays as thin as ½ inch can be satisfactorily applied in contrast to conventional techniques where overlays of at least about 1½ to 2 inches are required.

More specifically, in accordance with the present invention, there is provided a method of reconstructing asphalt pavement which comprises heating the pavement to its softening temperature during each of successive time-spaced intervals, the spacing between intervals being of sufficient duration to permit the conduction of enough heat into the interior of the pavement to elevate the temperature of successive incremental depths thereof to their softening temperature, scarifying the pavement to a predetermined depth, not exceeding the depth to which the pavement has been softened, and providing the scarified pavement with a trafficable surface.

Thus, the method of the present invention involves heating an asphalt pavement in successive stages while permitting the heat to "soak" into the pavement during intervals between the heating stages. In this manner, the surface of the pavement is maintained in a softened condition without being overheated, and at the same time, heat is allowed to penetrate into the interior of the asphalt pavement increasing the depth to which the pavement is elevated to above its softening point. By the time the scarification equipment is brought into contract with the pavement, the pavement has been presoftened to the desired depth of scarification so that only softened material is scarified.

In accordance with another aspect of the present invention, the scarified asphalt pavement is provided with a trafficable surface by leveling the scarified asphalt, rolling and compacting the same, and applying a material which increases the penetration of the asphaltic components of the pavement.

In accordance with a further aspect of the present invention, the scarified asphaltic pavement is provided with a trafficable surface by leveling the same, applying a composition which increases the penetration of the asphaltic component, applying an overlay of fresh asphaltic paving material, and rolling and compacting the overlayed material to provide a finished thickness of overlay of at least about ½ inch.

It is therefore an object of the invention to provide an improved method of reconditioning asphalt pavement.

A further object of the present invention is to provide a method of reconstructing asphalt which permits deep scarification of presoftened asphalt.

Yet another object of the present invention is to provide a method of reconstructing asphalt pavement wherein the pavement is heated in successive stages and wherein intervals are provided between heating stages to permit heat to be transferred by conduction to the interior of the pavement.

Yet another object of the invention is to provide an improved method of reconstructing asphalt pavement which allows for a saving in both heat and mechanical energy and which eliminates or least reduces substantially the amount of new asphaltic material required for reconstruction.

Still another object of the present invention is to provide a continuous method of reconditioning asphalt in a single pass which includes deep scarification of presoftened asphalt to a depth of 1 inch or more, followed by the working of the scarified asphalt pavement into a trafficable surface.

These and other objects, features, advantages and aspects of the invention will become more apparent from a reading of the following detailed description of the invention when taken in conjunction with the accompanying drawing.

DESCRIPTION OF THE DRAWING

The single sheet of drawing is a schematic flow sheet illustrating the steps of reconstructing asphalt pavement in accordance with the present invention.

DETAILED DESCRIPTION OF THE INVENTION

In accordance with a preferred embodiment of the present invention, the method comprises the steps of:

a. heating the surface of the pavement with radiant energy until a temperature at the pavement surface within the range of about 225°F to about 325°F is attained, thereby softening the surface, b. discontinuing the application of radiant energy to permit the heat applied to be conducted deeper into the asphalt pavement without overheating the surface, thereby softening the asphalt pavement to an incremental depth, c. re-exposing the previously heated surface of the pavement to a source of radiant energy to elevate its temperature to a value not exceeding about 325°F, thereby further softening the surface of the asphalt pavement, d. discontinuing the application of radiant energy to permit the heat last applied to be conducted deeper into the asphalt pavement without overheating the surface, thereby softening the asphalt pavement to a further incremental depth, e. scarifying the softened asphalt pavement to a depth not exceeding the said further incremental depth, and f. providing the scarified asphalt pavement with a trafficable surface.

With reference to the accompanying flow sheet, it will be seen that the provision of a trafficable surface starts with the step of leveling the scarified asphalt and is followed by one or two sets of steps depending on whether or not an overlay is to be applied.

Where the application of an overlay is omitted, the leveled, scarified asphalt pavement is rolled and compacted and then treated with a commercially available rejuvenator, such as Reclamite sold by Witco Chemical Company, Inc. of New York. This material is believed to be described in U.S. Pat. No. 3,162,101 to which reference can be made for a detailed chemical and physical description of the commercially available material.

Turning now to a more detailed discussion of the above-described steps of a preferred embodiment of the invention, heating steps (a) and (c) are preferably conducted using a source of radiant energy, i.e., a radiant heater. Suitable radiant heaters are commercially available. One such unit has a porous brick radiant wall of the type illustrated and described in U.S. Pat. No. 2,828,813. Such heaters may be fueled with a variety of combustible materials including natural gas, manufactured gas, propane, butane, pentane, and the like.

Although the particular design of radiant heater useful in the practice of the invention is not critical, it should be of such a design which will produce a radiant surface having a temperature within the range of about 1800° to about 2500°F. Radiant heaters providing surface temperatures outside this range may be used provided suitable adjustments are made in the distance between the surface of the radiant heater and the asphalt pavement, and the speed of movement of the heater across the pavement.

In general, the surface of the asphalt pavement should be heated to a temperature within the range of about 225°F to about 325°F. To provide an adequate margin of safety, a narrow range of 250°F to 300°F may be observed. In some instances, temperatures as high as 350°F may be used safely, depending upon the composition of the asphalt heated, but this temperature is known to damage some asphalts having fairly low boiling components.

The first indication that an asphalt is being overheated is the appearance of smoke, evidencing the vaporization of the light ends of the asphalt. This in itself is undesirable so that appearance of smoke should be countered with a reduction in the rate of heat transfer to the asphalt from the radiant heater. Any further increase in the temperature of the surface of the asphalt can result in flame burning as the light ends reach their flash point. This is to be avoided not only because of the detrimental effect of flaming on the asphalt, but also because of the fire hazard it creates and the pollution problem it generates.

As an alternative to continuous observation of the condition of the asphalt pavement during the heating step, it is possible to provide suitable temperature sensing means at the surface of the asphalt which either automatically, or by manual intervention, controls the fuel flow to the burner of the radiant heater. This is the most direct and the quickest way of reducing the rate of heat transfer from the radiant heater. Other adjustments which can be made, but which will produce a slower response include increasing the distance between the radiant heat surface and the surface of the asphalt pavement, and increasing the speed of the radiant heater across the surface of the asphalt pavement.

In general, it has been found that the temperature of an asphalt pavement surface can be maintained within the range of about 225°F to about 325°F by providing a radiant heat surface at a temperature within the range of about 1800°F to about 2500°F, establishing about a 4 inch distance between the surface of the radiant heat surface and the surface of the asphalt pavement, and maintaining a speed of the heater across the pavement within the range of about 12 to about 36 ft./min. These parameters apply where the ambient air temperature is within the range of about 50° to about 90°F, and the condition of the asphalt pavement is fairly dry. For operations at lower ambient air temperatures and/or where more than a minimal amount of water is present, the conditions would have to be adjusted to provide a greater rate of heat transfer, for example, by reducing the distance between the heater surface and the surface of the asphalt pavement, or lowering the rate of speed of the heater across the asphalt pavement surface. Under extremely hot and dry conditions, a reduction in heat transfer rates may be desirable or necessary.

Once the temperature of the surface of the asphalt pavement has reached the desired level, the application of heat is discontinued. Thereafter, for a period of time within the range of perhaps 4 to 10 seconds, and preferably within the range of about 5 to about 7 seconds, heat transferred to the surface of the asphalt pavement is permitted to be further transferred, by conduction, into the interior of the pavement. This has the effect of softening the asphalt pavement to an incremental depth while avoiding overheating of the surface of the pavement. During this period of conductive heat transfer, the temperature of the surface of the asphalt pavement is reduced slightly, but it remains in a softened condition.

Following the period during which heat is transferred by conduction, the pavement is re-exposed to a source of radiant energy to elevate its temperature to a value not exceeding about 325°F, thereby further softening the surface of the asphalt pavement. The same variables which applied to the initial heating step are equally applicable here. The purpose of this step is to drive additional heat into the surface of the asphalt pavement to replace the heat transferred away by conduction. After the surface of the asphalt has again reached a predetermined softening temperature, heating is discontinued and once again, the heat applied to the surface is permitted to be transferred by conduction deeper into the asphalt pavement to soften the pavement to a further incremental depth, again, without overheating the surface of the pavement.

With each of the two heating steps and each of the two "soaking" steps being conducted for a period within the range of about 5 to 7 seconds, and the other preferred conditions of heating being observed, the asphalt pavement extending to a depth to as least about 1 inch will have been heated to its softening temperature.

The pavement may then be scarified using the conventional equipment designed for this purpose. However, less rugged, lighter weight equipment than that embodied in the conventional designs may be used since only softened asphalt pavement is scarified and this requires little mechanical energy or strength compared to the amount of energy and strength required to scarify unsoftened asphalt pavement.

In addition to the energy-saving advantage, scarifying only softened asphalt pavement produces a performance advantage in the reconditioned asphalt pavement. When scarifying softened asphalt, i.e., with the asphalt at a temperature of at least about 210°F, movement of the aggregate takes place with minimal disturbance to the matrix of binder and aggregate which in turn minimizes the adverse affect of scarification on the strength, stability and load bearing qualities of the reconditioned asphalt pavement.

By contrast, when scarification is undertaken of asphalt pavement which is not softened, the effect is that of tearing out lumps of matrix from its environment and physically moving it to another environment. The forces acting upon the matrix of aggregate and binder are such that they produce a degradation of the matrix through comminution and segregation of the aggregate. This in turn reduces the strength, stability and load bearing qualities of the matrix.

The equipment used for leveling, rolling and compacting and applying the rejuvenating agent may be of conventional design. Similarly, the scarifier may be of conventional design except that since it is not necessary to apply very much mechanical energy to effect scarification, conventional equipment may be over-designed for use in the present invention. Accordingly, if scarifying equipment is to be built, less rugged materials than found in commercial scarifiers may be employed.

Variations in the above-described preferred embodiment will readily suggest themselves to those skilled in the art. For example, the heating of the asphalt pavement may be accomplished in more than two stages. Further, heat sources other than radiant surfaces may be employed, though not necessarily with equivalent results. Still further, the method may be used to repair and reconstruct isolated areas or patches of pavement although use of the method in a continuous manner to reconstruct a substantial stretch of pavement is preferred.

Experience has shown that the objects of the present invention, viz. heating asphalt pavement and softening it to a depth of about 1 inch or more, within a reasonably short period of time without overheating the surface of the pavement, cannot be accomplished in only one heating step. Thus, it is essential to the practice of the invention that heating be conducted in a plurality of stages, followed by intervals during which the heat applied is transferred by conduction into the interior of the pavement.

While the invention has been described with reference to certain specific embodiments, neither the embodiments described nor the terminology employed in describing them is intended to be limiting; rather, it is intended that the invention be limited only by the scope of the appended claims.

I claim:

1. A method of reconstructing asphalt pavement which comprises a. heating the surface of the pavement with radiant energy until a temperature at the pavement surface within the range of about 225°F to about 325°F is attained, thereby softening said surface;

b. discontinuing the application of radiant energy;

c. subjecting the structurally undisturbed pavement to a heat soaking step during which heat previously applied to the pavement surface is conducted into the interior of the pavement, the soaking interval being of sufficient duration to elevate the temperature of the interior of the pavement to at least the softening temperature of the asphalt;

d. repeating steps (a) through (c) at least once, whereby the temperature of the interior of the pavement, to a depth of at least about one inch, is elevated to at least the softening temperature of the asphalt;

e. scarifying the asphalt pavement to a depth not exceeding the depth to which the asphalt has been heated to at least its softening temperature, and f. providing said scarified asphalt pavement with a trafficable surface.

2. The method defined in claim 1 wherein the asphalt pavement scarified in step (e) is at a temperature of at least about 210°F.

3. The method defined in claim 1 wherein step (f) further comprises leveling annd then rolling the scarified asphalt pavement.

4. The method defined in claim 3 wherein step (f) further comprises applying a liquid composition to the rolled asphaltic pavement which increases the penetration of the asphaltic component thereof.

5. The method defined in claim 1 wherein step (f) comprises leveling the scarified asphalt, applying a liquid composition which increases the penetration of the asphaltic component thereof, applying an overlay of fresh asphaltic paving material, and rolling and compacting said last mentioned material.

6. The method defined in claim 5 wherein said fresh asphaltic paving material is applied in an amount sufficient to provide a rolled, compacted overlay of at least about ½ inch thick.

7. A continuous method of reconstructing asphalt pavement which comprises a. exposing the surface of the pavement to a radiant surface heated to a temperature within the range of about 1800°F to about 2500°F and continuing the exposure for a time sufficient to elevate the temperature of the surface of the pavement to a value within the range of from about 225°F to about 325°F, to thereby soften the pavement surface;

b. discontinuing the exposure of the surface of the pavement to said radiant surface;

c. subjecting the structurally undisturbed pavement to a heat soaking step during which heat previously applied to the pavement surface is conducted into the interior of the pavement, the soaking interval being of sufficient duration to elevate the temperature of the interior of the pavement to at least the softening temperature of the asphalt;

d. repeating steps (a) through (c) at least once, whereby the temperature of the interior of the pavement, to a depth of at least about one inch, is elevated to at least the softening temperature of the asphalt;

e. scarifying the asphalt pavement to a depth not exceeding the depth to which the asphalt has been heated to at least its softening temperature, and f. providing said scarified asphalt pavement with a trafficable surface.

8. The method defined in claim 7 wherein the asphalt pavement scarified in step (e) is at a temperature of at least about 210°F.

9. The method defined in claim 7 wherein step (f) further comprises leveling and then rolling the scarified asphalt pavement.

10. The method defined in claim 9 wherein step (f) further comprises applying a liquid composition to the rolled asphaltic pavement which increases the penetration of the asphaltic component thereof.

11. The method defined in claim 7 wherein step (f) comprises leveling the scarified asphalt, applying a liquid composition which increases the penetration of the asphaltic component thereof, applying an overlay of fresh asphaltic paving material, and rolling and compacting said last mentioned material.

12. The method defined in claim 11 wherein said fresh asphaltic paving material is applied in an amount sufficient to provide a rolled, compacted overlay of at least about ½ inch thick.

13. A method of reconstructing asphalt pavement comprising a. heating the surface of the pavement until a temperature at the pavement surface of at least about 225°F is attained, thereby softening said surface;

b. discontinuing the application of heat;

c. subjecting the structurally undisturbed pavement to a heat soaking step during which heat previously applied to the pavement surface is conducted into the interior of the pavement, the soaking interval being of sufficient duration to elevate the temperature of the interior of the pavement to at least the softening temperature of the asphalt;

d. repeating steps (a) through (c) at least once, whereby the temperature of the interior of the pavement, to a depth of at least one half inch, is elevated to at least the softening temperature of the asphalt;

e. scarifying the asphalt pavement to a depth not exceeding the depth to which the asphalt has been heated to at least its softening temperature, and f. providing said scarified asphalt pavement with a trafficable surface.

14. A method of reconstructing asphalt pavement comprising a. heating the surface of the pavement until a temperature at the pavement surface of at least about 225°F is attained, thereby softening said surface;

b. discontinuing the application of heat;

c. subjecting the structurally undisturbed pavement to a heat soaking step during which heat previously applied to the pavement surface is conducted into the interior of the pavement, the soaking interval being of sufficient duration to elevate the temperature of the interior of the pavement to at least the softening temperature of the asphalt;

d. repeating steps (a) through (c) at least once, whereby the temperature of the interior of the pavement, to an incremental depth, is elevated to at least the softening temperature of the asphalt;

e. scarifying the asphalt pavement to a depth not exceeding the depth to which the asphalt has been heated to at least its softening temperature, and f. providing said scarified asphalt pavement with a trafficable surface.

* * * * *